United States Patent [19]

Tsukagoshi

[11] Patent Number: 4,538,975

[45] Date of Patent: Sep. 3, 1985

[54] SCROLL TYPE COMPRESSOR WITH LUBRICATING SYSTEM

[75] Inventor: Yasuhiro Tsukagoshi, Ota, Japan

[73] Assignee: Sanden Corporation, Japan

[21] Appl. No.: 521,256

[22] Filed: Aug. 8, 1983

[51] Int. Cl.[3] ..... F04C 18/02; F04C 29/02

[52] U.S. Cl. ..... 418/55; 418/DIG. 1

[58] Field of Search ..... 418/55, DIG. 1

[56] References Cited

U.S. PATENT DOCUMENTS

| | | | |
|---|---|---|---|
| 3,924,977 | 12/1975 | McCullough | 418/55 |
| 4,209,287 | 6/1980 | Takada | 418/DIG. 1 |
| 4,259,043 | 3/1981 | Hidden et al. | 418/55 |
| 4,304,535 | 12/1981 | Terrauchi | 418/55 |
| 4,314,796 | 2/1982 | Terauchi | 418/55 |
| 4,332,535 | 6/1982 | Terauchi et al. | 418/DIG. 1 |
| 4,340,339 | 7/1982 | Hiraga et al. | 418/55 |
| 4,343,599 | 8/1982 | Kousokabe | 418/DIG. 1 |
| 4,345,886 | 8/1982 | Nakayama et al. | 418/100 |
| 4,396,364 | 8/1983 | Tojo et al. | 418/55 |
| 4,439,118 | 3/1984 | Iimori | 418/55 |

FOREIGN PATENT DOCUMENTS

| | | | |
|---|---|---|---|
| 55-60685 | 5/1980 | Japan | 418/55 |
| 76290 | 5/1982 | Japan . | |
| 148092 | 9/1982 | Japan . | |

*Primary Examiner*—William R. Cline
*Assistant Examiner*—John J. McGlew, Jr.
*Attorney, Agent, or Firm*—Banner, Birch, McKie & Beckett

[57] ABSTRACT

A lubricating system for a scroll type compressor is described. The compressor unit includes a housing having a front end plate and a cup shaped casing. A fluid inlet port is formed on the cup shaped casing and has a step portion radially projecting from an inner surface thereof. A first oil passageway is formed through the cup shaped casing with one end opening at the inner wall of the inlet port adjacent to the step portion. A second oil passageway is formed through the front end plate and connects with the first oil passageway. One end of the second oil passageway opens to a shaft seal cavity formed on the front end plate. Therefore, the shaft seal cavity is connected with the fluid inlet port by the first and second oil passageways, and the shaft assembly is lubricated and cooled by lubricating oil and suction gas flowing through the oil passageway. Further passageways convey lubricant from the shaft seal cavity to the bearing elements of the compressor and finally to the suction chamber of the compressor.

9 Claims, 4 Drawing Figures

SCROLL TYPE COMPRESSOR WITH LUBRICATING SYSTEM

BACKGROUND OF THE INVENTION

This invention relates to fluid displacement apparatus, and more particularly, to a scroll type fluid compressor.

Scroll type fluid displacement apparatus are well known in the prior art. For example, U.S. Pat. No. 801,182 (Creux) discloses a scroll type fluid displacement apparatus including two scroll members each having a circular end plate and a spiroidal or involute spiral element. These scroll members are maintained angularly and radially offset so that the spiral elements interfit to make a plurality of line contacts between their spiral curved surfaces, thereby to seal off and define at least one pair of fluid pockets. The relative orbital motion of the two scroll members shifts the line contacts along the spiral curved surfaces and, therefore, the fluid pockets change in volume. The volume of the fluid pockets increases or decreases dependent on the direction of the orbital motion. Therefore, scroll type fluid displacement apparatus are applicable to compress, expand or pump fluids.

Scroll type fluid displacement apparatus are particularly well-suited for use as a refrigerant compressor in an automobile air conditioner. Generally, it is desirable that the refrigerant compressor for an automobile air conditioner be compact in size and light in weight, since the compressor is placed in the engine compartment of an automobile. However, the refrigerant compressor is generally coupled to an electromagnetic clutch for transmitting the output of an engine to the drive shaft of the compressor. The weight of the electromagnetic clutch therefore increases the total weight of a compressor unit.

SUMMARY OF THE INVENTION

It is a primary object of this invention to provide an improved scroll type compressor which is compact in size and light in weight.

It is another object of this invention to provide a scroll type compressor which is simple in construction and configuration, and easy to assemble.

It is still another object of this invention to provide a scroll type compressor wherein moving parts, in particular a shaft seal portion, are efficiently lubricated and cooled.

It is a further object of this invention to provide a scroll type compressor which has an oil circulation channel for returning the lubricant oil from a discharge chamber to a suction chamber.

A scroll type compressor according to this invention includes a housing having a front end plate and a cup shaped casing. A fixed scroll is fixedly disposed relative to the cup shaped casing and has a first circular end plate from which a first spiral wrap extends into an inner chamber of the cup shaped casing. An orbiting scroll has a second circular end plate from which a second spiral wrap extends. The first and second wraps interfit at an angular and radial offset to make a plurality of line contacts to define at least one pair of sealed off fluid pockets. A driving mechanism is operatively connected with the orbiting scroll to effect the orbital motion of the orbiting scroll while preventing the rotation of the orbiting scroll by a rotation preventing mechanism, thus causing the fluid pockets to change volume due to the orbital motion of the orbiting scroll. A fluid inlet port is formed with a step portion. An oil passageway is formed through the housing, and one end of the passageway opens at a shaft seal cavity formed in the front end plate and the other end opens at the inlet port adjacent the step portion.

Further objects, features and other aspects of this invention will be understood from the following detailed description of the preferred embodiments of this invention referring to the annexed drawings.

DETAILED DESCRIPTION OF THE PREFERRED EMBODIMENT

Figure 1:
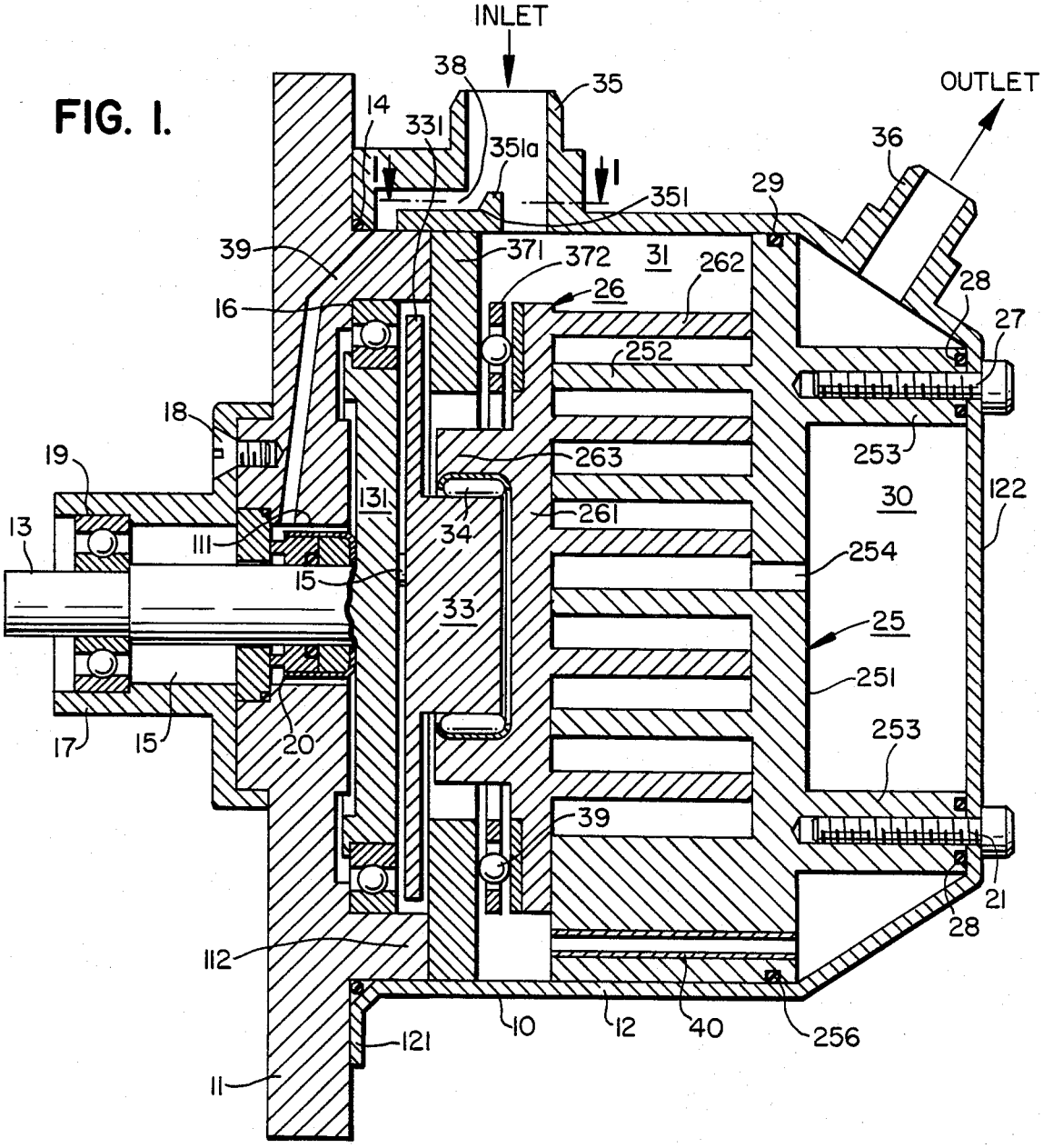
FIG. 1 is a vertical sectional view of a compressor unit according to one embodiment of this invention.
Figure 1A:
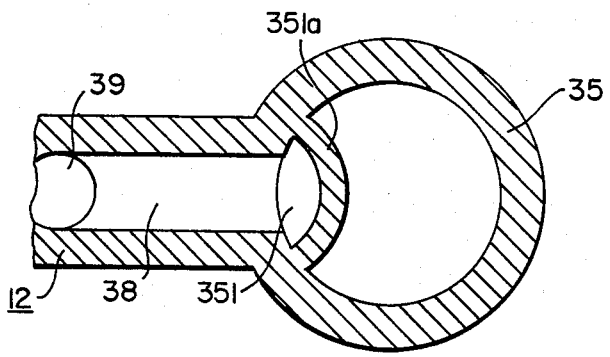
FIG. 1*a* is a sectional view taken generally along line 1—1 of FIG. 1.

Referring to FIG. 1, a refrigerant compressor unit in accordance with the present invention is shown. The unit includes a compressor housing 10 comprising a front end plate 11 and a cup shaped casing 12 which is attached to one side surface of front end plate 11. An opening 111 is formed in the center of front end plate 11 for penetration or passage of a drive shaft 13. An annular projection 112 concentric with opening 111 is formed on the inside face of front end plate 11 and projects towards cup shaped casing 12. An outer peripheral surface of projection 112 contacts an inner wall surface of casing 12. Cup shaped casing 12 has a flange portion 121 which extends radially outward from the open end of casing 12 and along the inside surface of end plate 11 and is fixed to front end plate 11 by a fastening means, for example, a bolt and nut, not shown. The open portion of cup shaped casing 12 is thereby covered and closed by front end plate 11.

An O-ring member 14 is placed between front end plate 11 and flange portion 121 of cup shaped casing 12, to thereby secure a seal between the fitting or mating surfaces of the front end plate 11 and cup shaped casing 12. However, O-ring member 14 is not necessarily disposed between flange portion 121 of cup shaped casing 12 and front end plate 11. O-ring 14 may be disposed between the outer surface of annular projection 112 of front end plate 11 and the inner surface of cup shaped casing 12.

Front end plate 11 has an annular sleeve portion 17 projecting outwardly from the front or outside surface thereof. Sleeve 17 surrounds drive shaft 13 and defines a shaft seal cavity. In the embodiment shown in FIG. 1, sleeve portion 17 is fixed to front end plate 11 by fastening means, such as screws 18. Alternatively, the sleeve portion 17 may be formed integral with front end plate 11.

Drive shaft 13 is rotatably supported by sleeve portion 17 through a bearing 19 disposed within the front end portion of sleeve portion 17. Drive shaft 13 is formed with a disk rotor 131 at its inner end portion, which is rotatably supported by front end plate 11 through a bearing 16 disposed within an inner peripheral surface of annular projection 112. A shaft seal assembly 20 is fixed on drive shaft 13 within the shaft seal cavity of front end plate 11.

Drive shaft 13 is coupled to an electromagnetic clutch, not shown, which may be disposed on the outer portion of sleeve portion 17. Thus, drive shaft 13 is driven by an external drive power source, for example, a motor of a vehicle, through a rotation force transmitting means such as an electromagnetic clutch.

A fixed scroll 25, an orbiting scroll 26, a driving mechanism for orbiting scroll 26 and a rotation preventing/thrust bearing means for orbiting scroll 26 are disposed in the inner chamber of cup shaped casing 12. The inner chamber is formed between the inner wall of cup shaped casing 12 and front end plate 11.

Fixed scroll 25 includes a circular end plate 251 and a wrap of spiral element 252 affixed to or extending from one major side surface of circular plate 251. Circular plate 251 of fixed scroll 25 is formed with a plurality of legs 253 axially projecting from its other major side surface, as shown in FIG. 1.

An axial end surface of each leg 253 is fitted against the inner surface of a bottom plate portion 122 of cup shaped portion 12 and fixed by screws 27 which screw into legs 253 from the outside of bottom plate portion 122. A first sealing member 28 is disposed between the end surface of each leg 253 and the inner surface of bottom plate portion 122, to thereby prevent fluid leakage along screws 27. A groove 256 is formed on the outer peripheral surface of circular plate 251 and a second seal ring member 29 is disposed therein to form a seal between the inner surface of cup shaped portion 12 and the outer peripheral surface of circular plate 251. Thus, the inner chamber of cup shaped portion 12 is partitioned into two chambers by circular plate 251; a rear or discharge chamber 30, in which legs 253 are disposed, and a front or suction chamber 31, in which spiral element 251 of fixed scroll 25 is disposed.

Cup shaped portion 12 is provided with a fluid inlet port 35 and a fluid outlet port 36, which respectively are connected to the front and rear chambers 31, 30. A hole or discharge port 254 is formed through the circular plate 251 at a position near to the center of spiral element 252. Discharge port 254 connects the fluid pocket formed in the center of the interfitting spiral elements and rear chamber 30.

Orbiting scroll 26 is disposed in front chamber 31. Orbiting scroll member 26 also comprises a circular end plate 261 and a wrap of spiral element 262 affixed to or extending from one side surface of circular end plate 261. Spiral element 262 and spiral element 252 interfit at an angular offset of 180° and a predetermined radial offset. A pair of fluid pockets are thereby defined between spiral elements 252, 262. Orbiting scroll 26 is connected to the drive mechanism and to the rotation preventing/thrust bearing mechanism. These last two mechanisms effect orbital motion of the orbiting scroll member 26 by rotation of drive shaft 13, to thereby compress fluid passing through the compressor unit according to the general principles described above.

Figure 2:
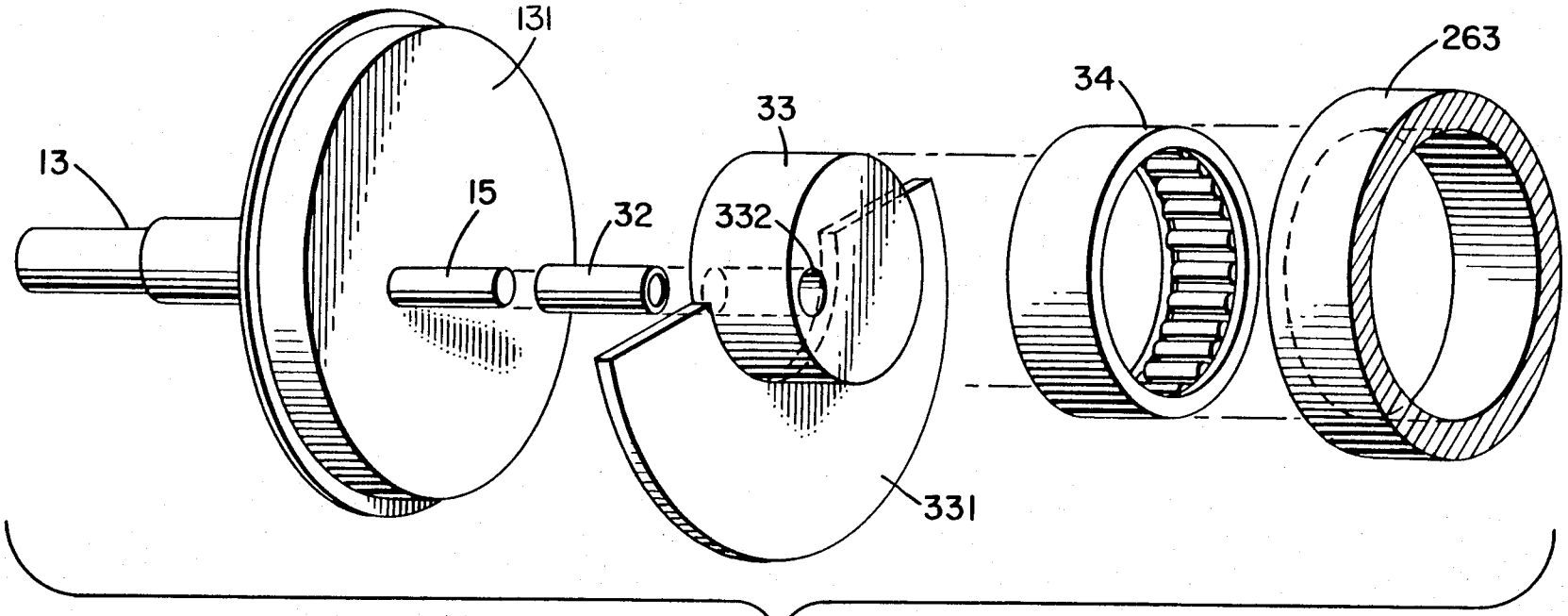
FIG. 2 is an exploded perspective view of a driving mechanism in the embodiment of FIG. 1.

Referring to FIGS. 1 and 2, the driving mechanism of orbiting scroll 26 will be described. Drive shaft 13, which is rotatably supported by sleeve portion 17 through ball bearing 19, is formed with a disk rotor 131. Disk rotor 131 is rotatably supported by front end plate 11 through ball bearing 16 disposed in the inner peripheral surface of annular projection 112.

A crank pin or drive pin 15 projects axially inwardly from an end surface of disk rotor 131 and is radially offset from the center of drive shaft 13. Circular plate 261 of orbiting scroll 26 is provided with a tubular boss 263 projecting axially outwardly from the end surface opposite to the side from which spiral element 262 extends. A discoid or short axial bushing 33 is fitted into boss 263, and is rotatably supported therein by a bearing, such as a needle bearing 34. Bushing 33 has a balance weight 331 which is shaped as a portion of a disk or ring and extends radially from bushing 33 along a front surface thereof. An eccentric hole, as shown in FIG. 2, is formed in bushing 33 radially offset from the center of bushing 33. Drive pin 15 is fitted into the eccentrically disposed hole 332, within which a bearing 32 may be inserted. Bushing 33 is therefore driven by the revolution of drive pin 151 and permitted to rotate by needle bearing 34. The spiral element of orbiting scroll 26 is thus pushed against the spiral element of fixed scroll 25 due to the moment created between the driving point and the reaction force acting point of the pressurized gas to secure the line contacts and effect radial sealing.

Figure 3:
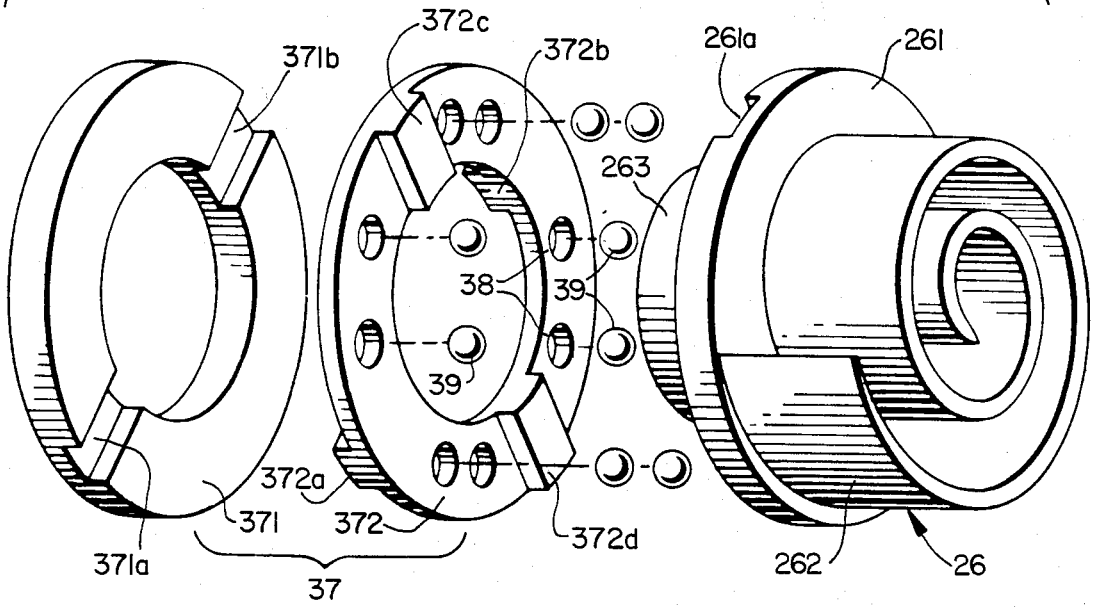
FIG. 3 is an exploded perspective view of rotation preventing/thrust bearing mechanism in the embodiment of FIG. 1.

Referring to FIG. 3 and FIG. 1, a rotation preventing/thrust bearing means 37 is disposed to surround boss 263 and is comprised of a fixed ring 371 and a sliding ring 372. Fixed ring 371 may be secured to an end surface of annular projection 112 of front end plate 11 by a pin. Fixed ring 371 is provided with a pair of keyways 371*a* and 371*b* in an axial end surface facing orbiting scroll 26. Sliding ring 372 is disposed in a hollow space between fixed ring 371 and circular plate 261 of orbiting scroll 26. Sliding ring 372 is provided with a pair of keys 372*a* and 372*b*. Therefore, sliding ring 372 is slidable in the radial direction by the guide of keys 372*a* and 372*b* within keyways 371*a* and 371*b*. Sliding ring 372 is also provided with a pair of keys 372*c* and 372*d* on its opposite surface. Keys 372*c* and 372*d* are arranged along a diameter perpendicular to the diameter along which keys 372*a* and 372*b* are arranged. Circular plate 261 of orbiting scroll 26 is provided with a pair of keyways (in FIG. 3, only keyway 261*a* is shown, the other keyway is disposed diametrically opposite to keyway 261*a*) on a surface facing sliding ring 272 in which are received keys 372*c* and 372*d*. Therefore, orbiting scroll 26 is slidable in a radial direction by the guide of keys 372*c* and 372*d* within the keyways of circular plate 261.

Accordingly, orbiting scroll 26 is slidable in one radial direction with sliding ring 372 (i.e., in keyways 371*a* and 371*b*), and is slidable in another radial direction (i.e., in keyways 261*a* and 261*b* (not shown)) independently. The second sliding direction is perpendicular to the first radial direction. Therefore, orbiting scroll 26 is prevented from rotating, but is permitted to move in two radial directions perpendicular to one another.

In addition, sliding ring 372 is provided with a plurality of pockets or holes 38 which are formed in an axial direction. A bearing means, such as balls 39, each having a diameter which is larger than the thickness of sliding ring 372, are retaining in pockets 38. Balls 39 contact and roll on surfaces of fixed ring 371 and circular plate 261. Therefore, the thrust load from orbiting scroll member 26 is supported on fixed ring 371 through balls 39.

Referring to FIG. 1, a lubricating mechanism for the compressor will be described. A step portion 351 is formed in fluid inlet port 35. Step portion 351 projects radially inwardly from an inner wall of fluid inlet port 35. A flange 351*a* is formed along the inner end portion of step portion 351 and is perpendicular to step portion 351 to accumulate and separate oil at step portion 351. Flange 351*a* projects radially outward from step portion 351 as viewed with respect to the rotational axis of shaft 13. Cup shaped casing 12 is formed with a first oil passageway 38 one end of which opens at the inner wall of fluid inlet port 35. First oil passageway 38 is connected with a second oil passageway 39 which opens at the inner wall of opening 111 at the shaft seal cavity. The shaft seal cavity in which shaft seal assembly 20 is disposed is thus connected with fluid inlet port 35 through oil passageways 38 and 39.

In this construction, during the operation of the compressor, the refrigerant gas is introduced into suction chamber 31 through inlet port 35. The oil mist suction gas strikes against step portion 351. The oil included with the suction gas is separated therefrom and accumulates on step portion 351. Following the flow of suction gas, the accumulated oil flows into first oil passageway 38, and then flows out to the shaft seal cavity of front end plate 11 through second oil passageway 39. The oil which flows into the shaft seal cavity lubricates and cools the shaft seal assembly 20 and returns to the suction chamber 31 through bearing 16 while lubricating bearing 16.

Furthermore, as shown in FIG. 1, of an orifice portion 40 can be formed through end plate 251 of fixed scroll 25, so that the separating oil which accumulates in discharge chamber 30 can be returned to suction chamber 31 through orifice 40 due to the pressure difference between the suction and discharge chambers. Therefore efficient lubrication is attained with a small amount of lubricating oil.

The invention has been described in detail in connection with a preferred embodiment, but this is an examples only and this invention is not restricted thereto. It will be easily understood by those skilled in the art that the other variations and modifications can be easily made within the scope of this invention, which is defined only by the following claims.

I claim:

1. In a scroll type compressor including a housing comprising a front end plate and a cup shaped casing, an inner chamber formed between an inner wall of said cup shaped casing and said front end plate, a fixed scroll fixedly disposed within said inner chamber and having a fixed scroll end plate from which a first wrap extends, an orbiting scroll disposed within said inner chamber having an orbiting scroll end plate from which a second wrap extends, said first and second wraps interfitting at an angular and radial offset to make a plurality of line contacts to define at least one pair of sealed off fluid pockets, said fixed scroll end plate dividing said inner chamber into a discharge chamber and a suction chamber, a driving mechanism operatively connected with said orbiting scroll to effect the orbital motion of said orbiting scroll while preventing the rotation of said orbiting scroll, and thus changing the volume of said fluid pockets due to the orbital motion of said orbiting scroll, the improvement comprising:

a fluid inlet port formed in said cup shaped casing and having an opening to said suction chamber for admitting a fluid to said suction chamber, the wall of said fluid inlet port having an aperture formed therethrough, said aperture formed above said fluid inlet port opening to said suction chamber, said aperture having an upper edge surface and a lower edge surface, a step portion fixed to said lower edge surface of said aperture and projecting substantially perpendicular to said inner wall of said fluid inlet port and thus substantially perpendicular to the fluid flow through said inlet port for separating oil from the fluid flow before the fluid flow enters said inner chamber;

a first lubricant passageway formed in said housing having one end opening to said aperture formed in said inner wall of said fluid inlet port; and a second lubricant passageway formed through said front end plate, said second lubricant passageway connecting said first lubricant passageway and a shaft seal cavity formed in said front end plate, so that lubricant separates from incoming fluid to be compressed on said step portion and passes therefrom to said seal cavity through said first and second lubricant passageways.

2. The scroll type compressor of claim 1 wherein said fixed scroll end plate partitions said housing into a discharge chamber and a suction chamber, said fixed scroll end plate having an opening therethrough connecting said intake and discharge chambers of the scroll type compressor so that lubricant from the discharge chamber can be returned to the intake chamber through said opening.

3. The scroll type compressor of claim 1 wherein said step portion has a flange fixed to and perpendicular to the inner end portion of said step portion, one end of said flange abutting said step portion so that said flange is directed away from said inner chamber.

4. The scroll compressor of claim 1 further comprising lubricant passageway means for conveying lubricant from said shaft seal cavity to an intake chamber of the scroll type compressor.

5. A scroll type compressor comprising:

a housing comprising a front end plate and a cup shaped casing;

an inner chamber formed between an inner wall of said cup shaped casing and said front end plate;

a fluid inlet port formed in said housing, said fluid inlet port having a first opening through which a fluid is admitted into said fluid inlet port and a second opening into said inner chamber, said fluid inlet port further having an aperture in a wall thereof, said aperture positioned between said first and second openings, said aperture having an upper edge and a lower edge;

a fixed scroll fixedly disposed within said inner chamber and having a first circular end plate from which a first wrap extends into said inner chamber of said housing, said first circular end plate dividing said inner chamber into an intake chamber and a discharge chamber;

an orbiting scroll disposed within said inner chamber, said orbiting scroll having a second circular end plate from which a second wrap extends, said first and second wraps interfitting at an angular and radial offset to make a plurality of line contacts to define at least one pair of sealed off fluid pockets;

a driving mechanism operatively connected to said orbiting scroll to effect the orbital motion of said orbiting scroll while preventing rotation of said orbiting scroll;

a step portion fixed to said lower edge of said aperture in said inner wall of said fluid inlet port and projecting substantially perpendicular to said inner wall of said fluid inlet port and thus substantially perpendicular to the fluid flow through said inlet port for separating lubricant from fluid flowing into said inlet port;

a first lubricant passageway formed through said cup shaped casing and opening to said aperture in said inner wall of said inlet port; and a second lubricant passageway formed through said front end plate and connecting said first lubricant passageway with a shaft seal cavity formed in said front end plate.

6. The scroll type compressor of claim 5 wherein said first circular end plate of said fixed scroll partitions said housing into a discharge chamber and a suction chamber, and further comprising at least one opening through said first circular end plate of said fixed scroll for connecting said intake and discharge chambers of the scroll type compressor so that lubricant from said discharge chamber can be returned to said intake chamber through said opening.

7. In a scroll type compressor including a housing adapted to rotatably support a drive shaft, said housing including a front end plate and a cup shaped casing, an inner chamber formed between an inner wall of said cup shaped casing and said front end plate, a fixed scroll fixedly disposed within said inner chamber and having an end plate from which a first wrap extends, an orbiting scroll disposed within said inner chamber having an end plate from which a first wrap extends, said first and second wraps interfitting at an angular and radial offset to make a plurality of line contacts to define at least one pair of sealed off fluid pockets, said fixed scroll end plate dividing the inner chamber of said cup shaped casing into a discharge chamber and a suction chamber, a driving mechanism opertively connected with said orbiting scroll to effect the orbiting motion of said orbiting scroll while preventing the rotation of said orbiting scroll, said driving mechanism rotatably supported within said housing, and a lubricating system for the scroll type compressor, the improvement wherein said lubricating system comprises:

an inlet port formed in said housing for introducing an oil misted fluid into said suction chamber of the scroll compressor, said fluid inlet port having a first opening through which fluid is admitted, a second opening to said inner chamber, and an aperture formed in a sidewall of said fluid inlet port, said aperture positioned between said first and second openings, said aperture having an upper edge and a lower edge;

a step portion fixed to said lower edge of said aperture and projecting from an inner wall of said inlet port for separating oil from the oil misted suction fluid prior to the fluid entering said inner chamber, said step portion having a flange fixed to and perpendicular to the end of said step portion, one end of said flange abutting said step portion so that said flange is directed away from said inner chamber; and passageway means for conveying the separated oil to lubricate the rotating elements of the scroll compressor, said passageway means opening to said aperture in said fluid inlet port.

8. The scroll type compressor as recited in claim 7 wherein said passageway means comprise a first passageway one end of which opens to said aperture in said inner wall of said inlet port, and a second passageway formed through said front end plate, said second passageway connecting said first passageway with a shaft seal cavity formed in said front end plate.

9. A scroll type compressor as recited in claim 8 wherein said passageway means further comprises a third passageway connecting said discharge chamber and said suction chamber.

* * * * *